United States Patent [19]

Robinson

[11] 4,238,183

[45] Dec. 9, 1980

[54] METHOD AND DEVICE FOR INCREASING EFFICIENCY OF NATURAL GAS FUEL

[76] Inventor: T. Garrett Robinson, 101 N. Clifton Ave., Wilmington, Del. 19805

[21] Appl. No.: 119,379

[22] Filed: Feb. 7, 1980

Related U.S. Application Data

[63] Continuation-in-part of Ser. No. 34,411, Apr. 30, 1979, Pat. No. 4,201,140.

[51] Int. Cl.[3] ..... F23K 5/00

[52] U.S. Cl. ..... 431/2; 55/3; 55/100; 110/218; 335/209

[58] Field of Search ..... 431/2, 3; 110/218; 55/3, 100; 335/209

[56] References Cited

U.S. PATENT DOCUMENTS

| | | | |
|---|---|---|---|
| 3,004,137 | 10/1961 | Karlovitz | 431/2 X |
| 3,087,472 | 4/1963 | Asakawa | 431/2 X |
| 3,349,354 | 10/1967 | Miyata | 335/209 |
| 3,976,726 | 8/1976 | Johnson | 431/2 X |
| 4,170,447 | 10/1979 | Goldstein et al. | 431/2 X |

*Primary Examiner*—Edward G. Favors

*Attorney, Agent, or Firm*—Connolly and Hutz

[57] ABSTRACT

A device for increasing efficiency of natural gas fuel includes a first housing having a magnet chamber with a plurality of vertically arranged sets of magnets. The natural gas is fed thereto from an inlet chamber through a distributor plate having an array of holes. After the magnetic treatment, the natural gas is fed to a second similar housing before being burned as fuel.

16 Claims, 5 Drawing Figures

METHOD AND DEVICE FOR INCREASING EFFICIENCY OF NATURAL GAS FUEL

CROSS REFERENCE TO RELATED APPLICATION

This application is a continuation-in-part of parent application Ser. No. 34,411 filed Apr. 30, 1979 now U.S. Pat. No. 4,201,140.

BACKGROUND OF INVENTION

Parent application Ser. No. 34,411 discloses a device for increasing the efficiency of fuel such as coal dust and the like and a further device for fuel in liquid form. The present invention relates to a device of the latter type, but particularly adapted for treating natural gas fuel.

SUMMARY OF INVENTION

An object of this invention is to provide a method and device for increasing the efficiency of natural gas fuel in a simple and effective manner.

In accordance with this invention natural gas fuel is treated by distributing the natural gas in a magnet chamber in a first housing having sets of vertically arranged magnets which subject the fuel to a magnetic flux. The treated natural gas is then further magnetically treated in a second similar housing and then supplied to a burner.

In the preferred embodiment of this invention the inlet chamber of each housing has a liquid pool of a noise dampening material. The magnets are preferably mounted in non-magnetic casings having axial passageways aligned with the holes of the distributor plates.

THE DRAWINGS

DETAILED DESCRIPTION

The present invention is generally based upon the first embodiment of parent application Ser. No. 34,411, the details of which are incorporated herein by reference thereto. In that embodiment of the aforenoted parent application, liquid fuel is treated by directing the fuel into the inlet chamber of a first housing and then through a distributor plate into a magnet chamber having sets of vertically arranged magnets which apply a magnetic flux to the fuel. The treated fuel undergoes a similar treatment in a second housing, and in accordance with the parent application the treated fuel is also subjected to an electrostatic force applied by electrodes in an electrode chamber which may be located at various locations such as at the top of the first housing downstream from the magnet chamber. The present invention is based upon the recognition that where the fuel is natural gas the efficiency thereof can be increased without the inclusion of the electrode chamber. The present invention adds other refinements to the type of structure disclosed in the parent application.

Figure 1:
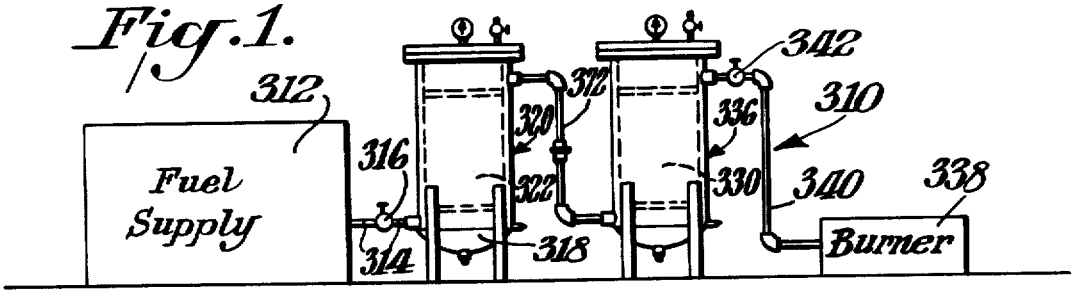
FIG. 1 is a schematic view in elevation of a device in accordance with one embodiment of this invention.

FIGS. 1-5 show an embodiment of this invention which is particularly designed for the treatment of natural gas such as methane. More particularly, device 310 is designed to increase the combustion efficiency of the natural gas. As illustrated in FIG. 1, device 310 includes a natural gas supply chamber 312 of any suitable construction having a discharge pipe 314 so that fuel flows therethrough as controlled in any suitable manner such as by valve 316. From pipe 314 the fuel flows into inlet chamber 318 of vertically disposed housing or casing 320. A first magnet chamber 322 is provided above in flow communication with inlet chamber 318.

In accordance with this invention a second magnet chamber 330 is provided in second housing 336 downstream from first housing 320. Apparently the second magnet chamber 330 acts as a compensator to maximize the efficiency of the practice of the invention by its sets 332 of vertically arranged magnets acting to complete the randomization of the molecular arrangement in the fuel thereby effectively complementing the initial randomization.

In the preferred embodiment of this invention second housing 336 is located downstream and separate from first housing 320. The separate housings are preferred for maintenance and installation purposes. It is to be understood, however, that the concepts of this invention may be practiced by having both housings combined into a common housing.

After the fuel has been subjected to the double magnet dose, the thusly treated fuel is fed into burner 338. FIG. 1, for example, illustrates a feed pipe 340 with its valve 342 to control the feed of fuel to burner 338.

Figure 3:
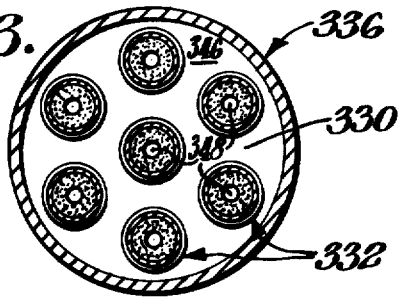
FIG. 3 is a cross-sectional view taken through FIG. 2 along the line 3—3.
Figure 2:
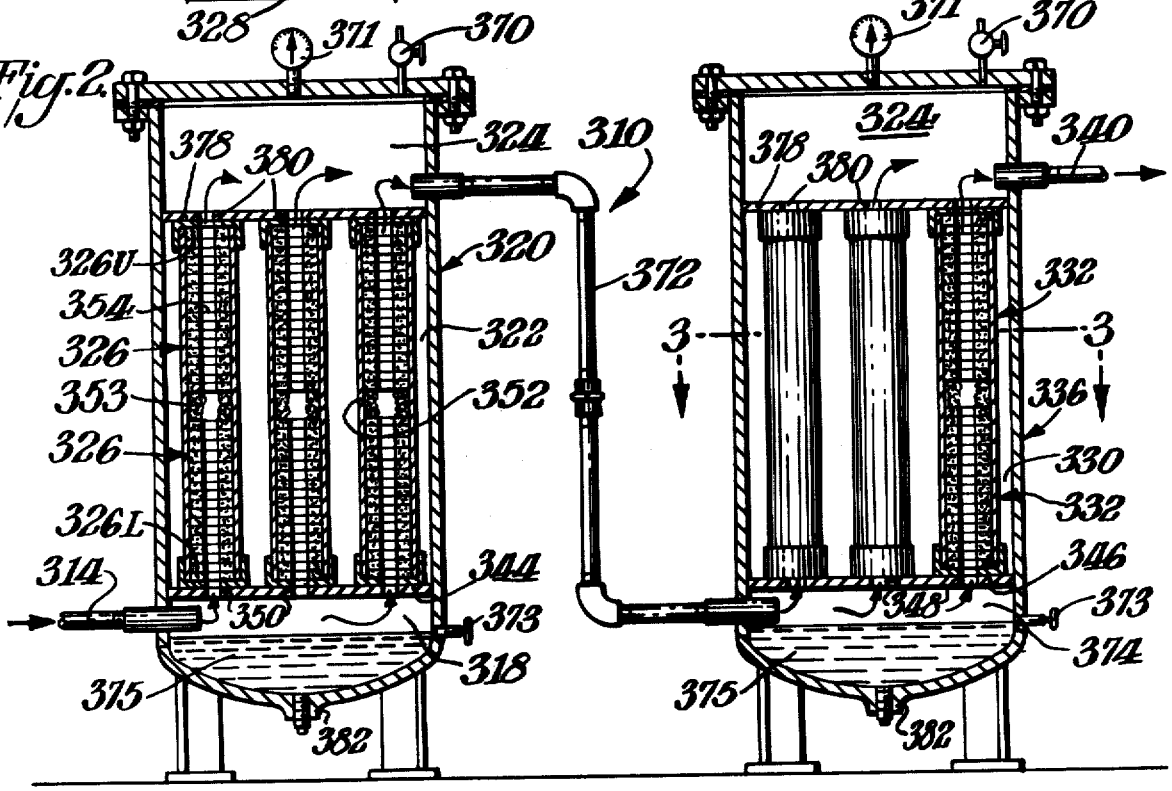
FIG. 2 is a cross-sectional view in elevation of a portion of the device in FIG. 1.

The invention may be practiced with various structural arrangements. For example, FIG. 2 illustrates distributor means 334 between inlet chamber 318 and first magnet chamber 322. In the illustrated form, distributor means 344 comprises a plate having a series of spaced apertures 350 so that the fuel is fed into chamber 322 in a predetermined pattern designed to maximize the effect of the magnetic flux operating upon the fuel. A similar plate 346 would likewise be provided for second magnet chamber 330. FIG. 3 illustrates an arrangement of six sets of vertically disposed magnets 326 in a circular pattern within chamber 330. Such arrangement might also be used in first magnet chamber 322. FIG. 3 further illustrates plate 346 to have a series of distributor holes 348 disposed in a circular pattern aligned with the circular array of magnets 326. Such an arrangement would likewise be used in plate 344 with the provision of holes 350. Similar plates 378 with holes 380 would be at the top of each magnet chamber.

Figure 4:
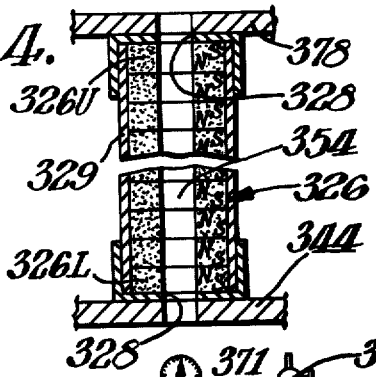
FIG. 4 is an elevation view partly in section of a portion of one of the magnet assemblies shown in FIG. 2.

Any suitable number of sets of magnets 326, 330 may be used within the concepts of this invention. Preferably, however, at least four sets are used, while larger industrial installations may have 28 or more sets. Preferably each set includes an upper group $326_U$ and a lower group $326_L$ with a gap 352 between the magnets of each set. In the embodiment, as illustrated in FIGS. 2-4, the sets of magnets 326 are constructed as, for example, ring magnets providing an axial passageway 354 which extends through aligned openings 328 in casings 329 in further alignment with respective holes in the distributor plates. Casing 329 is made of a non-magnetic material such as copper and are cylindrical in shape. The outer surfaces of lowermost magnet $326_L$ and the uppermost magnet $326_U$ are of the same polarity. More specifically, in the illustrated embodiment, the south poles of each magnet $326_L$ and $326_U$ are mounted outermost with the north poles innermost. As previously indicated and as illustrated, the upper set of magnets $326_U$ and lower set of magnets $326_L$ are spaced from each other at gap 352 in the generally longitudinally central area of the casings 329 with the magnets mounted opposite each other at gap 352 being of the same polarity which is of a polarity opposite that of the remote ends of magnets $326_L$ and $326_U$. A non-magnetic spacer 353 is provided in gap 352 made, for example, of crumpled copper screening held by copper or brass wire to provide a doughnut shape in gap 352. The sets of magnets 332 would be of similar construction but of reverse polarity.

If desired each set of magnets 326 or 330 include more than one gap rather than simply a single upper and a single lower group of magnets. In such arrangement the polarity of the magnets at each gap would likewise be the same. Further the gap or gaps need not be located uniformly since it is not necessary that each group of magnets be of the same length or number as each other group.

Each outlet chamber 324 further includes vent 370 and a pressure gauge 371. Chamber 324 in first housing 320 includes an outlet pipe 372 so that the treated fuel may be fed into inlet chamber 374 of second housing 336 upstream from plate 346. As previously noted, a second outlet chamber 324 is provided downstream from second magnet chamber 330 from which the treated fuel is fed into pipe 340 to the burner 338.

As illustrated in FIG. 2, outlet distributor plates 378 are provided at the downstream end of each magnet chamber 322, 330 with their apertures 280 to comprise a part of the fuel passageways. Advantageously, these plates serve the additional function of supporting the sets of magnets. Thus the casings 329 for the magnets 326 are supported by and between plates 344, 378 in the first vessel or housing 320, while the casings 329 for the sets of magnets 332 are supported by and between plates 346, 378 in the second vessel or housing 336. Each vessel 320, 326 is preferably made of a metal which may be of a magnetic material. In the illustrated arrangement of FIG. 2, each vessel 320, 326 has a 48 inch outside diameter and is about 110 inches high. Advantageously, inlet chamber 318, first magnet chamber 322 and outlet chamber 324 are conveniently mounted in the same housing with a drain 382 being provided at the lower end of inlet chamber 318. The number of sets of magnets and their dimensions would vary in accordance with the size of vessel.

As shown in FIG. 2, each inlet chamber 318, 374 is provided with a noise dampening material 375 which is preferably a liquid pool of a suitable material such as mineral oil. The level of noise dampening material 375 is slightly below the inlets of pipes 314 and 374. The pool level is controlled by any suitable means such as petcock 373. As the natural gas fuel is fed into each inlet chamber, liquid pool 375 acts as a shock absorber to halt or minimize any whistling noise that might otherwise result. Drains 382 permit the periodic draining of inlet chambers 318, 374 so that foreign matter and moisture will not unduly accumulate. As previously indicated, the invention may be practiced with first and second housings 320, 336 being parts of one large vessel or common housing. Separate housings, however, are preferable to facilitate access to the magnets, plumbing and other parts thereof for maintenance and installation purposes.

By aligning the distributor plate holes with axial passageways 354, the natural gas is forced into intimate contact with the magnets so as to maximize the efficiency of the magnets.

Figure 5:
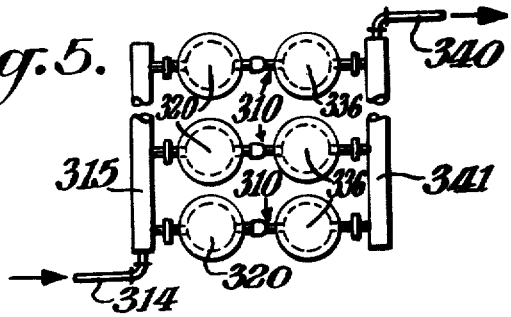
FIG. 5 is a plan view schematically showing the parallel connection of a plurality of the devices shown in FIG. 2.

FIG. 5 illustrates a desirable practice of this invention wherein any suitable number of devices 310 are connected in parallel with each other from a common fuel supply to a common burner. As illustrated in FIG. 5, each first housing 320 is fed natural gas from a manifold 315 communicating with inlet pipe 314 and correspondingly each second housing feeds its treated natural gas to a manifold 341 into outlet pipe 340 which leads to the burner.

Other variations of this invention are also possible within the teachings set forth herein.

What is claimed is:

1. A device for increasing the efficiency of natural gas fuel comprising a source of natural gas, a first housing, a first inlet chamber in the lower portion of said first housing, said source of natural gas communicating with said first inlet chamber for supplying natural gas thereto, a first magnet chamber in said first housing downstream from said first inlet chamber, said first magnet chamber having a plurality of sets of vertically arranged magnets for applying a magnetic flux to the natural gas flowing therethrough, said first inlet chamber and said first magnet chamber being separated from each other by a first distributor plate having a plurality of spaced holes extending therethrough for feeding the natural gas into said first magnet chamber in an array of spaced locations corresponding to the array of said plurality of sets of vertically arranged magnets, a second housing downstream from said first housing, a second inlet chamber in said second housing communicating with said first magnet chamber of said first housing whereby the treated natural gas may be supplied into said second housing, a second magnet chamber in said second housing downstream from said second inlet chamber, said second magnet chamber having a plurality of sets of vertically arranged magnets for applying a further magnetic flux to the treated natural gas flowing therethrough, said second inlet chamber and said second magnet chamber being separated from each other by a second distributor plate having a plurality of spaced holes extending completely therethrough for feeding the treated natural gas into said second magnet chamber in an array of spaced locations corresponding to the array of said plurality of sets of magnets in said second magnet chamber, and a burner downstream from and communicating with said second magnet chamber for burning the treated natural gas.

2. The device of claim 1 wherein each of said plurality of sets of vertically arranged magnets comprises a plurality of non-magnetic casings, two sets of magnets in each of said casings spaced from each other by a non-magnetic spacer, an axial passageway extending through each of said casings and said two sets of magnets and spacer therein, and said distributor plate holes being aligned with said axial passageways.

3. The device of claim 2 wherein said casings are symmetrically arranged in its respective housing, each of said casings being a copper cylinder, each of said spacers being a ring shaped copper screening, and each of said casings being mounted on its respective distributor plate with the upper end of each of said casings mounted against a further distributor plate having a corresponding pattern of holes.

4. The device of claim 2 wherein at least four of said casings are in each of said magnet chambers.

5. The device of claim 1 wherein said first and second housings are separate from each other and are in communication with each other by hollow tubing.

6. The device of claim 5 wherein each of said housings includes an outlet chamber downstream from and in communication with its magnet chamber, and said hollow tubing extending from said outlet chamber of said first housing to said inlet chamber.

7. The device of claim 2 wherein each of said sets of magnets are groups of ring magnets having the same polarity as each other adjacent said spacer and the same polarity as each other remote from said spacer.

8. The device of claim 7 wherein said magnets of said second housing are of reverse polarity to said magnets in said first housing.

9. The device of claim 1 wherein noise dampening material is disposed in the lower portion of said first inlet chamber below its connection with said source of natural gas entering said first inlet chamber.

10. The device of claim 9 wherein said noise dampening material is a liquid pool, said first inlet chamber including a drain at its bottom for draining said liquid pool, and liquid level means in said first inlet chamber below said connection with said source of natural gas for maintaining said liquid pool at a predetermined level.

11. The device of claim 10 wherein said noise dampening material is a liquid pool of mineral oil.

12. The device of claim 1, in combination therewith, a plurality of said first and said second housings, said source of natural gas including a supply container, each of said first inlet chambers being connected in parallel to said supply container by a common feed manifold, and each of said second housings being connected in parallel to said burner by a common discharge manifold.

13. A method of increasing the efficiency of natural gas fuel comprising the steps of feeding natural gas into an inlet chamber at the bottom of a first housing, passing the natural gas from the inlet chamber through a plurality of spaced holes in a distributor plate into a magnet chamber having a plurality of sets of vertically arranged magnets corresponding to the holes of the distributor plate, applying a magnetic flux from the magnets to the natural gas to magnetically treat the natural gas flowing through the magnet chamber, feeding the treated natural gas into the inlet chamber in the bottom of a second housing downstream from the first housing, passing the treated natural gas through a plurality of spaced holes in a distributor plate in the second housing and into a magnet chamber in the second housing having a plurality of sets of vertically arranged magnets corresponding to the holes in the second housing distributor plate, applying a magnetic flux from the magnets in the second housing to the treated natural gas to further magnetically treat the natural gas, and feeding the thusly treated natural gas into a burner where it is burned.

14. The method of claim 13 wherein the natural gas is passed through the holes of each distributor plate into axial passageways formed through the magnets and the non-magnetic casings in which the sets of magnets are mounted.

15. The method of claim 13 including placing a noise dampening liquid pool at the bottom of each inlet chamber, and feeding the natural gas into each inlet chamber at a level above its respective liquid pool.

16. The method of claim 13 including simultaneously feeding the natural gas from a single supply source into a plurality of first housings interconnected in parallel by a common manifold, and simultaneously discharging the treated natural gas from a plurality of second housings interconnected in parallel by a common manifold communicating with a single burner.

* * * * *